US010538924B2

(12) United States Patent
Anderson

(10) Patent No.: US 10,538,924 B2
(45) Date of Patent: Jan. 21, 2020

(54) BOARD/TILE SPACER AND ASSOCIATED PACKAGE ASSEMBLY

(71) Applicant: Ronald Scott Anderson, Don Mills (CA)

(72) Inventor: Ronald Scott Anderson, Don Mills (CA)

(73) Assignee: THE HILLMAN GROUP, INC., Cincinnati, OH (US)

( * ) Notice: Subject to any disclaimer, the term of this patent is extended or adjusted under 35 U.S.C. 154(b) by 1504 days.

(21) Appl. No.: 14/449,863

(22) Filed: Aug. 1, 2014

(65) Prior Publication Data

US 2016/0032598 A1 Feb. 4, 2016

(51) Int. Cl.
*E04F 21/20* (2006.01)
*E04F 21/00* (2006.01)

(52) U.S. Cl.
CPC ..... *E04F 21/0092* (2013.01)

(58) Field of Classification Search
CPC .... E04F 21/1838; E04F 21/0092; E04F 21/20
USPC ..... 52/677, 685, 686
See application file for complete search history.

(56) References Cited

U.S. PATENT DOCUMENTS 2,031,684 A 12/1932 Berger
2,930,135 A 3/1960 Rodtz, Sr.
3,139,229 A 6/1964 De Pasquale
3,383,027 A 5/1968 Brinkama et al.
3,745,735 A 7/1973 Casano
4,733,477 A 3/1988 Fincham et al.
4,793,068 A 12/1988 Golkar
4,862,668 A 9/1989 DeGooyer
4,953,341 A 9/1990 Joos
5,351,457 A * 10/1994 Colen ..... E04B 2/10 52/438
5,459,938 A 10/1995 Knight et al.
6,612,045 B2 9/2003 Kruskamp
6,625,951 B1 9/2003 McCarthy
6,823,640 B1 11/2004 Pytlewski
D542,161 S 5/2007 Skillings
7,313,872 B1 1/2008 Nygard
7,516,558 B2 4/2009 Frank et al.
7,698,831 B2 4/2010 Higgs et al.
7,861,487 B2 1/2011 Kufner et al.
7,992,354 B2 8/2011 Doda, Jr.
8,011,164 B2 9/2011 Kufner et al.
8,099,926 B2 1/2012 Kufner et al.
8,205,348 B2 6/2012 Baros et al.
2005/0257468 A1 11/2005 Serros et al.
2012/0023766 A1 2/2012 Hillebrandt
2013/0255182 A1 10/2013 Kufner et al.
2014/0360130 A1* 12/2014 Kufner ..... E04F 21/22 52/749.11

* cited by examiner

*Primary Examiner* — King M Chu
(74) *Attorney, Agent, or Firm* — Thompson Hine L.L.P.

(57) ABSTRACT

A spacer member for spacing boards or tiles includes a plurality of spacing wings extending from a core, where at least two of the spacing wings are movably connected to the core such that the spacer member has both a working configuration and a collapsed configuration.

16 Claims, 6 Drawing Sheets

BOARD/TILE SPACER AND ASSOCIATED PACKAGE ASSEMBLY

TECHNICAL FIELD

This application relates generally to spacer members used for spacing deck boards or tiles and, more specifically, to a spacer member that includes an advantageous collapsed configuration for purposes of packaging/shipment.

BACKGROUND

In the field of construction, spacer members are often used to define a suitable spacing between deck boards or tiles. As pertains to decking, the desired board spacing can vary depending upon board size and material.

U.S. Patent Publication No. 2005/0257468 discloses a four winged/legged tile spacer. U.S. Pat. Nos. 2,031,684, 4,862,668, and 6,612,045 disclose variations of four winged/legged spacers.

Although spacers with four spacing wings are known, it would be desirable to provide a spacer member that facilitates use for different spacing widths and/or provides advantageous packaging and shipment.

SUMMARY

In one aspect, a spacer member for spacing boards or tiles includes a hub and first, second, third and fourth spacing wings extending from the hub. At least the first spacing wing and the second spacing wing are movably connected to the hub such that the spacer member has both a working configuration and a collapsed configuration.

In one implementation of the spacer member, the first spacing wing and the second spacing wing extend from substantially opposite sides of the hub, and the third spacing wing and the fourth spacing wing extend from substantially opposite sides of the hub. In the working configuration the first spacing wing and the second spacing wing extend substantially parallel to each other, the third spacing wing and fourth spacing wing extend substantially parallel to each other, and the first spacing wing and the second spacing wing each extend substantially perpendicular to the third spacing wing and the fourth spacing wing. In the collapsed configuration, the third spacing wing and fourth spacing wing extend substantially parallel to each other, the first spacing wing is positioned alongside one of the third spacing wing or the fourth spacing wing, and the second spacing wing is positioned alongside one of the third spacing wing or the fourth spacing wing.

In one implementation of the spacer member, the first spacing wing and the second spacing wing extend from substantially opposite sides of the hub; and the third spacing wing and the fourth spacing wing extend from substantially opposite sides of the hub. In the working configuration the first spacing wing is spaced apart from both the third spacing wing and the fourth spacing wing, and the second spacing wing is spaced apart from both the third spacing wing and the fourth spacing wing. In the collapsed configuration, the first spacing wing is positioned alongside one of the third spacing wing or the fourth spacing wing, and the second spacing wing is positioned alongside one of the third spacing wing or the fourth spacing wing.

In one implementation, the third spacing wing and the fourth spacing wing extend from substantially opposite sides of the hub and generally parallel to each other. A thickness of the spacer member runs substantially perpendicular to the third and fourth spacing wings. The thickness of the spacer member when in the collapsed configuration is no more than thirty percent of the thickness of the spacer member when in the working configuration.

In one implementation, the spacer member is formed of a plastic material, a first living hinge connects the first spacing wing to the hub and a second living hinge connects the second spacing wing to the hub.

In one implementation, the first living hinge acts to bias the first spacing wing into a working position corresponding to the working configuration, and the second living hinge acts to bias the second spacing wing into a working position corresponding to the working configuration.

In one implementation, in the absence of any external force holding the spacer member in the collapsed configuration, the first and second spacing wings tend to move toward respective positions that correspond to the working configuration.

In one implementation, the first, second, third and fourth spacing wings each individually define respective spacing widths and collectively define at least three different spacing widths.

In another aspect, a package assembly includes packaging material defining a carrying space, and a spacer member positioned within the carrying space and held in the collapsed configuration by the packaging material.

In one implementation, the packaging material comprises a blister card package, a clam shell package or a bag.

In one implementation, upon removal of the spacer member from the packaging material, the first and second spacing wings tend to move toward respective positions that correspond to the working configuration.

In another aspect, a kit includes a container having a closure, the container holding (i) a plurality of threaded fasteners and (ii) the package assembly.

In one implementation, the container is a box member and the closure is a lid on the box member.

In another aspect, a spacer member for spacing boards or tiles includes a plurality of spacing wings extending from a core, where at least two of the spacing wings are movably connected to the core such that the spacer member has both a working configuration and a collapsed configuration.

In one implementation of the spacer member, in the working configuration each one of the plurality of the spacing wings extends outwardly from the core such that the spacer member has a substantially cross-shaped profile when viewed along an axis of the core. In the collapsed configuration a first pair of the spacing wings lie alongside each other and a second pair of the spacing wings lie alongside each other. In the absence of any external force holding the spacer member in the collapsed configuration, the spacing wings tend to move toward respective positions that correspond to the working configuration.

In another aspect, a packaged spacer member for spacing boards or tiles includes a packaging material defining a carrying space and a spacer member having a plurality of spacing wings. The spacer member has a working configuration and a collapsed configuration. The spacer member is positioned within the carrying space and held in the collapsed configuration by the packaging material.

In one implementation, the packaging material includes a blister card package, a clam shell package or a bag.

In one implementation, upon removal of the spacer member from the packaging material, the spacer member tends to shift from the collapsed configuration toward the working configuration.

In another aspect, a spacer member for spacing boards or tiles includes first, second, third and fourth spacing wings extending from a core. The first, second, third and fourth spacing wings each individually define respective spacing widths and collectively define at least three different spacing widths.

In one implementation, at least the first spacing wing and the second spacing wing are movably connected to the core such that the spacer member has both a working configuration that is cross-shaped, and a collapsed configuration.

In another aspect, a deck board installation method includes: (a) positioning a first deck board on a support arrangement, (b) positioning a second deck board on the support arrangement, (c) positioning a spacing member with a first spacing wing extending downward between the first and second deck boards, (d) moving at least one of the boards so that the first spacing wing defines a gap size between the first and second deck boards, (e) placing a first screw into the first deck board to secure the first deck board to the support arrangement, where the first screw is placed at a location defined by a recess at the end of a second spacing wing, and (f) placing a second screw into the second deck board to secure the second deck board to the support arrangement, where the second screw is placed at a location defined by a recess at the end of a third spacing wing. Thereafter, moving the spacer along the gap between the first and second deck boards to another location where steps (e) and (f) can be repeated.

The details of one or more embodiments are set forth in the accompanying drawings and the description below. Other features, objects, and advantages will be apparent from the description and drawings, and from the claims.

DETAILED DESCRIPTION

Figure 1:
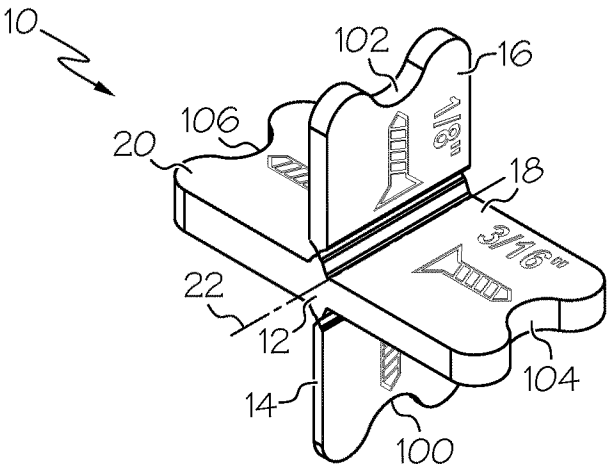
FIG. 1 is a perspective view of one embodiment of a spacer member.

Referring to FIG. 1, a perspective view of one embodiment of a spacer member 10 is shown. The spacer member includes a hub or core portion 12, with a plurality of spacing wings 14, 16, 18 and 20 extending outwardly away from the hub or core. The core 12 includes a central axis 22, and each of the wings extends away from the central axis 14.

Figure 2:
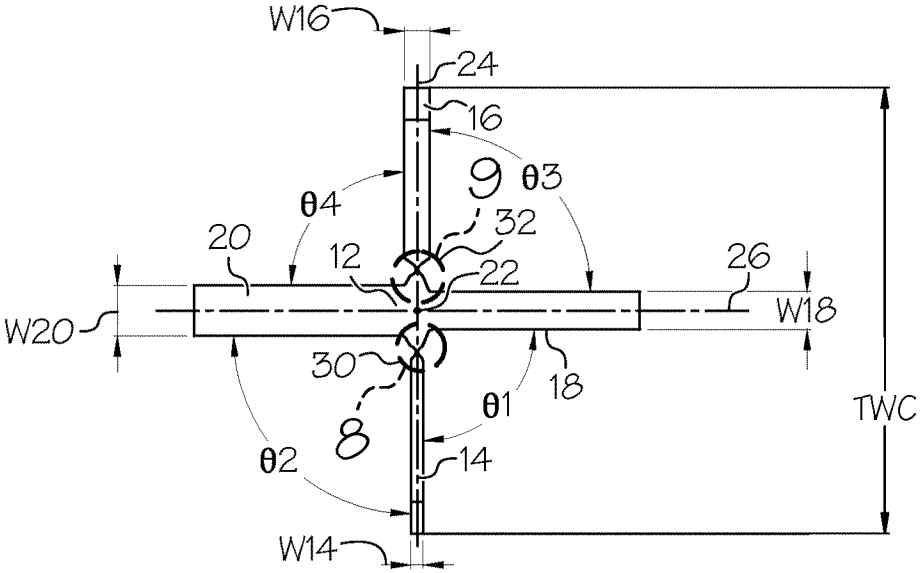
FIG. 2 shows an end profile view of the spacer member of FIG. 1.

As best seen in the end profile of FIG. 2, with the profile taken looking along the central axis 14, wings 14 and 16 extend from substantially opposite sides of the hub 12 and generally parallel to each other. Likewise, wings 18 and 20 extend from substantially opposite sides of the hub 12 and generally parallel to each other. Each spacing wing defines a respective spacing width W14, W16, W18 and W20. In the illustrated embodiment, four distinct spacing widths are defined (e.g., W14=1/16", W16=1/8", W18=3/16" and W20=1/4"), but other variations are possible. For example, all four of the spacing widths could be the same, or two or three of the spacing widths could be the same. As shown, each spacing wing may include indicia thereon (e.g., integrally molded therein or printed or imprinted thereon) that advises the user of the spacing width defined by the particular spacing wing.

In the illustrated embodiment, spacing wings 14 and 16 lie within or along a common plane 24, and spacing wings 18 and 20 lie within or along a common plane 26. The two planes 24 and 26 are perpendicular to each other. Thus, spacing wings 14 and 16 extend substantially perpendicular to spacing wings 18 and 20. Likewise, the spacing wing 14 is spaced apart from both the spacing wings 18 and 20 (by angles $\Theta 1$ and $\Theta 2$ of approximately 90 degrees in each case), and the spacing wing 16 is spaced apart from both the spacing wings 18 and 20 (by angles $\Theta 3$ and $\Theta 4$ of approximately 90 degrees in each case).

Figure 3:
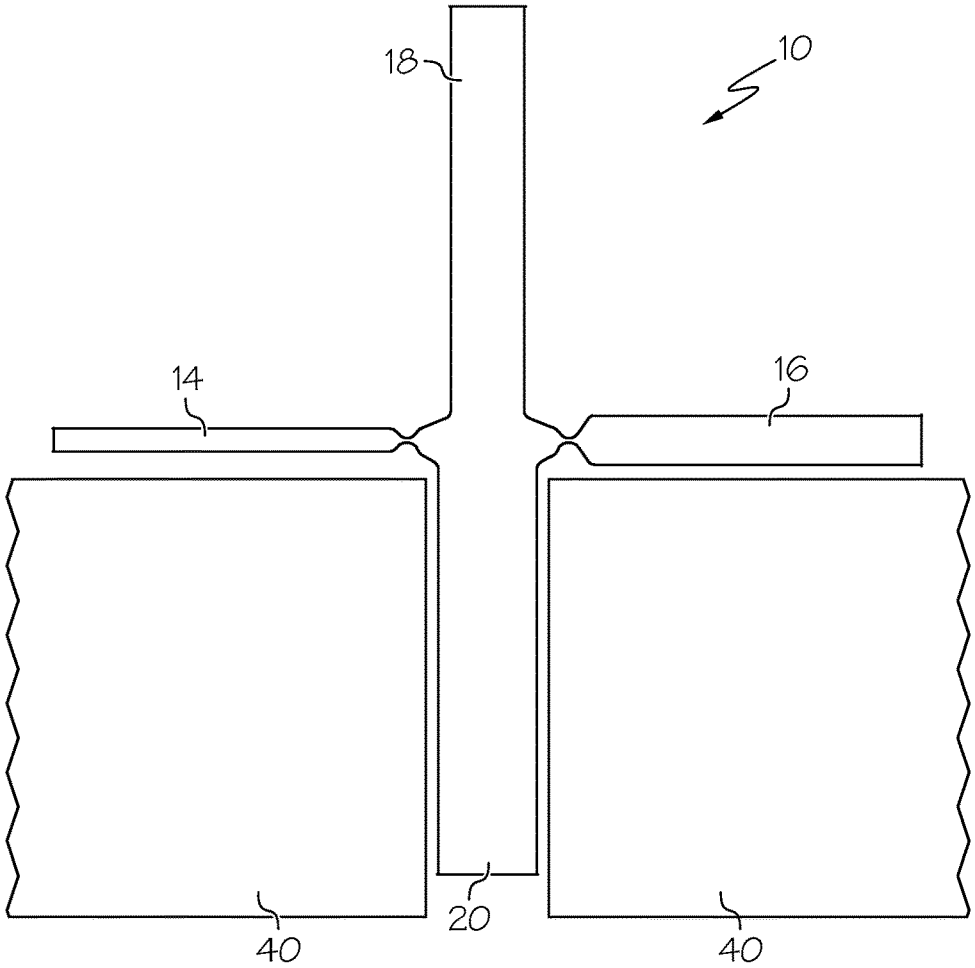
FIG. 3 shows the spacer member of FIG. 1 in use for spacing deck boards.
Figure 4:
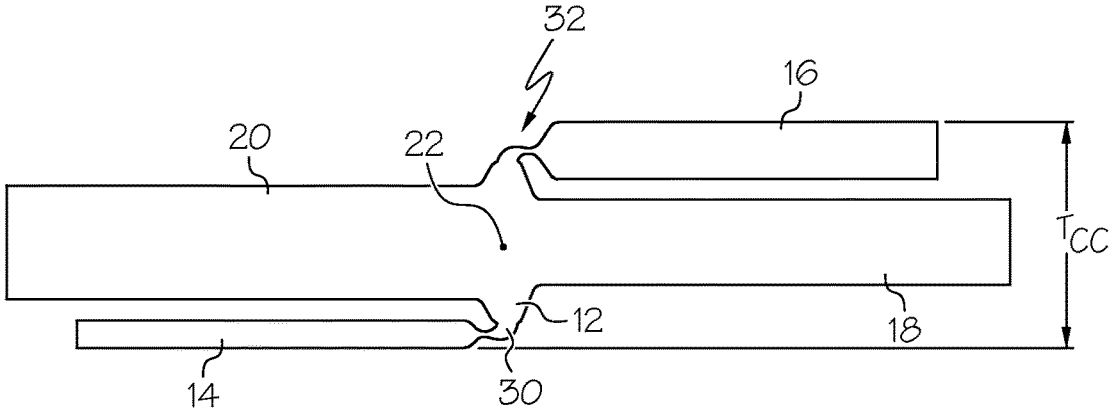
FIG. 4 shows the spacer member of FIG. 1 in a collapsed configuration.

Spacing wing 14 is connected to the hub 12 via a hinge portion 30 and spacing wing 16 is connected to the hub 12 via a hinge portion 32. The hinge portions allow the spacing wings 14 and 16 to pivot, rotate or otherwise move. In this regard, the orientation of FIGS. 1 and 2 shows the spacing member 10 in a working configuration, which is generally cross-shaped as described above. The working configuration is useful for positioning and movement of the spacer member 10 between boards 40 to define the spacing between the boards 40 (or tiles) as generally shown in FIG. 3. By moving the spacing wings 14 and 16, the spacer member can be reconfigured into a collapsed configuration that is useful for packaging of the spacer member as reflected in FIG. 4.

In the collapsed configuration, the spacing wings 18 and 20 extend substantially parallel to each other, the spacing wing 14 is positioned alongside the spacing wing 20 and the spacing wing 16 is positioned alongside the spacing wing 18. Each hinge is configured to allow its associate spacing wing to pivot or rotate in either direction, so that in an alternative collapsed configuration the spacing wing 14 could be positioned alongside spacing wing 18 and the spacing wing 16 could be positioned alongside spacing wing 20. Moreover, if desired, both spacing wings 14 and 16 could be positioned alongside the same one of the spacing wings 18 or 20.

As noted above, the collapsed configuration of the spacer member facilitates packaging. In particular, considering the illustrated embodiment, where a thickness of the spacer member runs substantially perpendicular to the third and fourth spacer members or the plane 26, the thickness $T_{CC}$ (FIG. 4) of the spacer member when in the collapsed configuration is substantially smaller than the thickness $T_{WC}$ (FIG. 2) of the spacer member when in the working configuration. By way of example, thickness $T_{CC}$ may be no more than thirty percent (e.g., no more than twenty-five percent, nor more than twenty percent or in some cases no more than fifteen percent) of the thickness $T_{WC}$, resulting in significantly reduced package volume/size.

Figure 5:
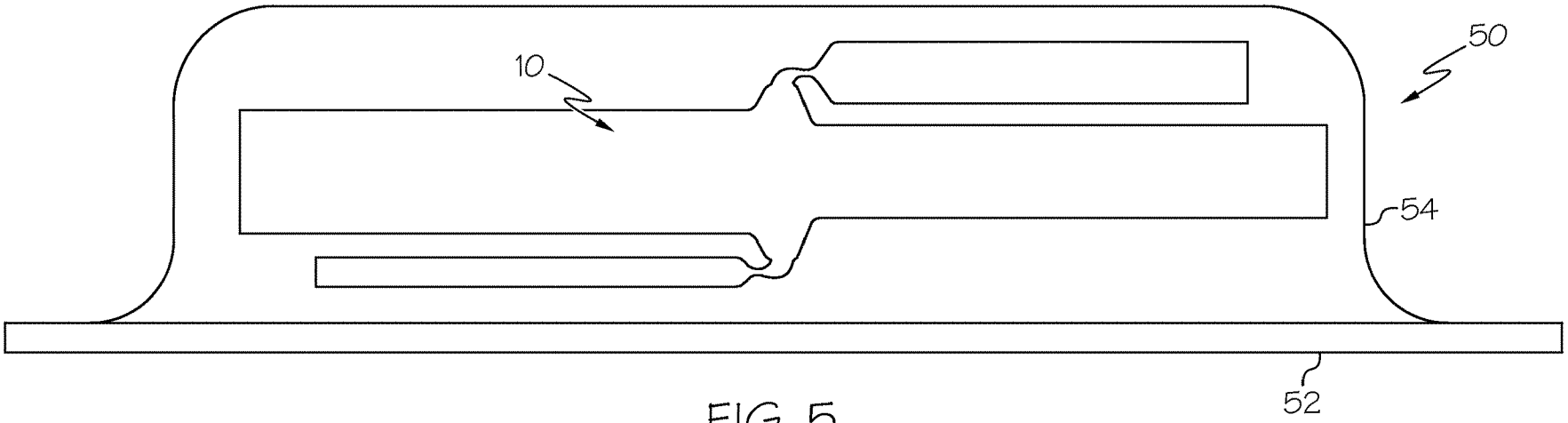
FIG. 5 shows one embodiment of a package assembly.
Figure 6:
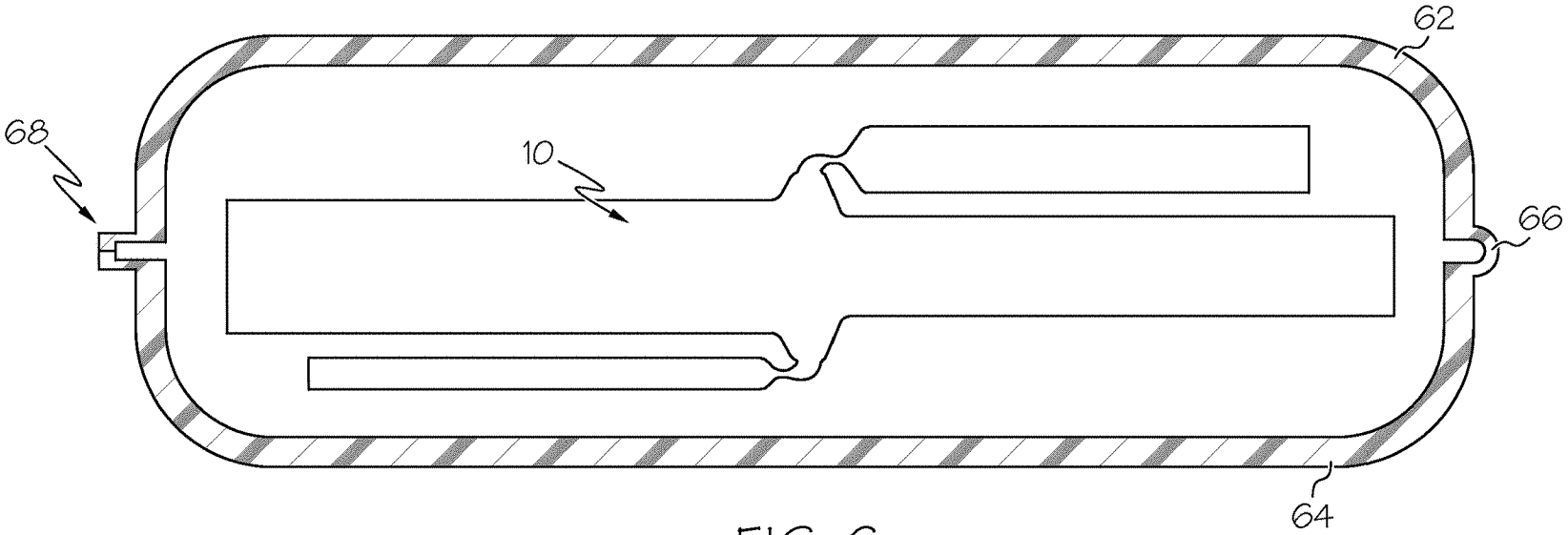
FIG. 6 shows another embodiment of a package assembly.
Figure 7:
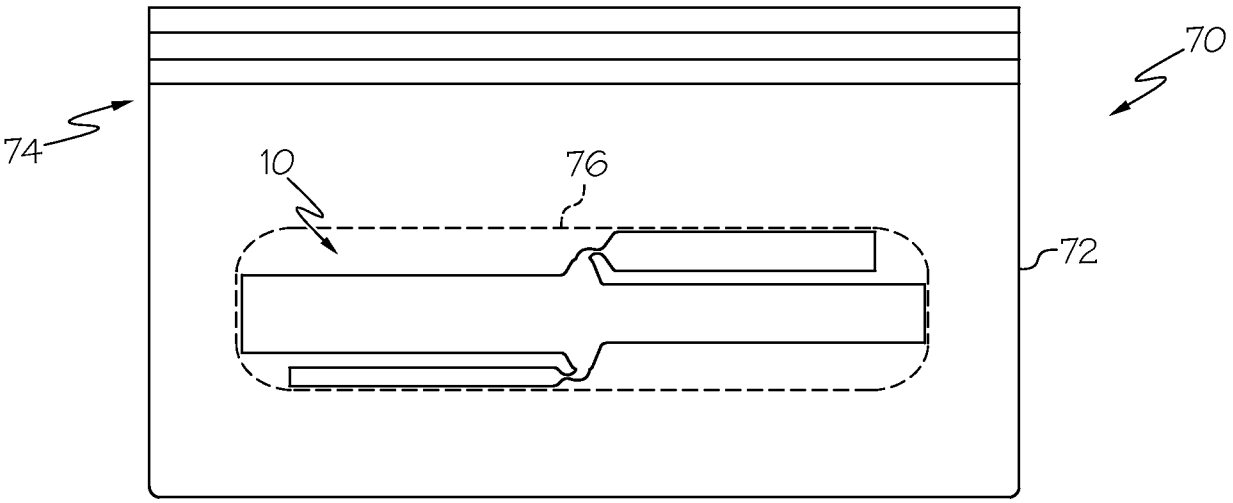
FIG. 7 shows another embodiment of a package assembly.

In this regard, reference is made to FIGS. 5, 6 and 7 showing different package assembly embodiments for the spacer member. In FIG. 5, the package assembly 50 includes a spacer member 10 held in the collapsed configuration within a carrying space of the package between a panel member 52 (e.g., paperboard) and a blister member 54 (e.g., clear plastic). Multiple spacer members could likewise be packaged in such a blister arrangement. In FIG. 6, the package assembly 60 includes one or more spacer members 10 held in the collapsed configuration within a carrying space of the package between upper and lower clamshell members 62 and 64 that are pivotably connected at hinge 66 to enable opening of the package. Edges 68 of the clam shell members may include suitable inter-engaging clasp or latch structure to releasably hold the clamshell package in the closed condition. In FIG. 7, the package assembly 70 includes one or more spacer members 10 held in the collapsed configuration within a carrying space of a bag material 72 that includes a closable end 74 (e.g., with zip or other mating closure structure). In any of the foregoing package assembly embodiments, additional material may be provided within the package along with the spacer member(s). Moreover, the packaging material for the spacer member(s) 10 may also include associated ties or strapping 76 (per FIG. 7) to help maintain the spacer member in the collapsed configuration. By way of example, plastic strap material, rubber band material or synthetic or natural fiber tie material may be used for the strapping 76.

Figure 9:
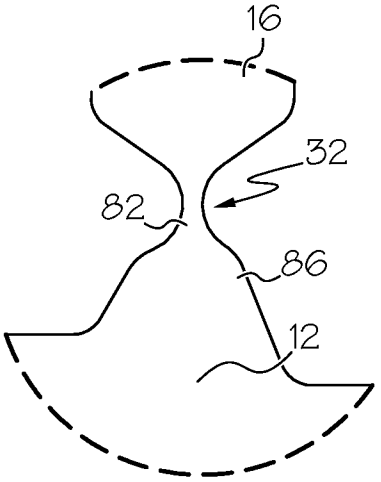
FIGS. 8 and 9 show enlarged partial views of the living hinges of FIG. 2.
Figure 8:
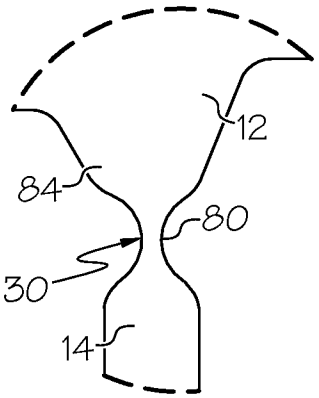

Referring now to FIGS. 8 and 9, exemplary living hinge structures 30 and 32 are shown. It is contemplated that the spacer member may be of a molded plastic material that facilitates production of the living hinge. By way of example, polypropylene, polyethylene, polycarbonate, acrylonitrile butadiene styrene or another polymer (e.g., any suitable thermoplastic polymer) may be used. Each living hinge 30 and 32 is formed by a narrow band of material 80, 82 that connects the respective spacing wings 14, 16 to the hub or core 12. Each narrow band of material is offset slightly from the hub or core 12 by a respective projection 84, 86 that narrows when moving outward from the hub or core. The projections 84, 86 help to assure that each spacing wing 14, 16 has sufficient space to pivot a full ninety degrees in either direction without coming into contact with the adjacent spacing wing 18 or 20 in a manner that could tend to unduly strain the living hinge and cause undesired breakage (e.g., in some cases some contact may be permitted, but contact that induces high stresses on the hinge is avoided).

In some embodiments, the living hinges may be formed so as to bias the spacing wings 14, 16 toward the working positions that represent the working configuration (e.g., the positions shown in FIG. 2). That is, the natural tendency of the structure due to the material composition and/or characteristics in combination with the configuration of the living hinge results in a bias such that, in the absence of any external force holding the spacer member in the collapsed configuration, the spacing wings 14, 16 tend to move toward respective positions that correspond to the working configuration. The natural bias also helps to keep the spacing wings 14 and 16 in their working positions, making the spacer member easier to use and handle during board or tile spacing. In one implementation, where the spacer members are formed of molded plastic, the spacer members may be manipulated shortly after production (e.g., while the spacer member is still warm) to assure desired flexibility of the living hinges. Such manipulation may involve moving each the spacing wings 14 and 16 one or more times in order to flex the living hinges.

In the illustrated embodiment, the living hinges are formed on (i) only two of the four spacing wings, (ii) two spacing wings that are positioned in opposed relationship to each other and (iii) the two spacing wings that are the two thinnest of the four. However, variations are possible, including 1, 3 or 4 of the spacing wings having a living hinge feature. In certain implementations the thickness of the living hinge may be between about 0.010 and about 0.020 inches (e.g., between about 0.012 inches and about 0.017 inches). However, other variations are possible.

Figure 10:
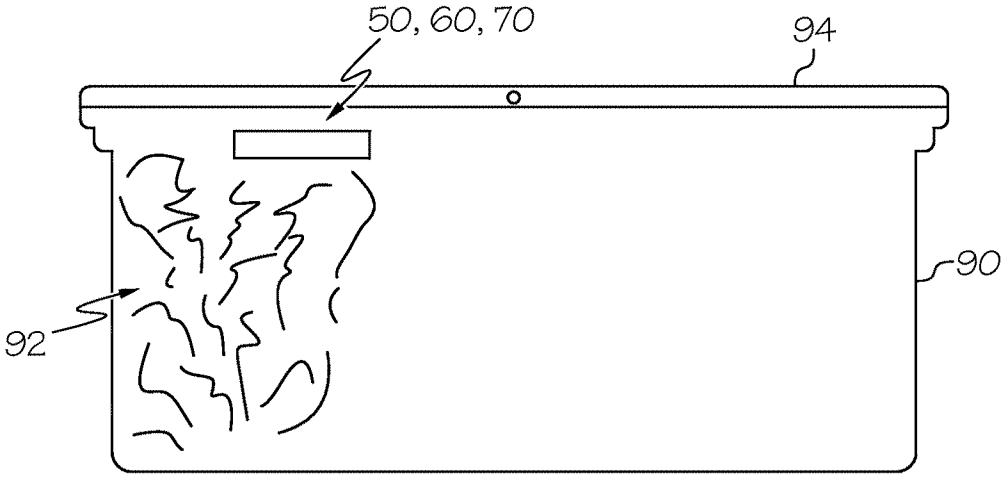
FIG. 10 shows a fastener kit including a spacer member incorporated therein.

The spacer members may be packaged and sold as standalone items or may be sold in combination with other items (e.g., as a kit). By way of example, and referring to FIG. 10, one or more spacer members 10 may be incorporated into a container 90 that holds a plurality of threaded fasteners 92 (e.g., of the type used for securing deck boards in place). The container has a closure 94 that may be used to access the fasteners 92, and the spacer member may typically be placed atop the fasteners for ready retrieval when the container 90 is initially opened. In one embodiment, the container 90 is a box member (e.g., of plastic) and the closure is a lid (e.g., of plastic) on the box member. The lid may be completely removable and/or may have a pivotable door to access the internal compartment of the container.

Figure 14:
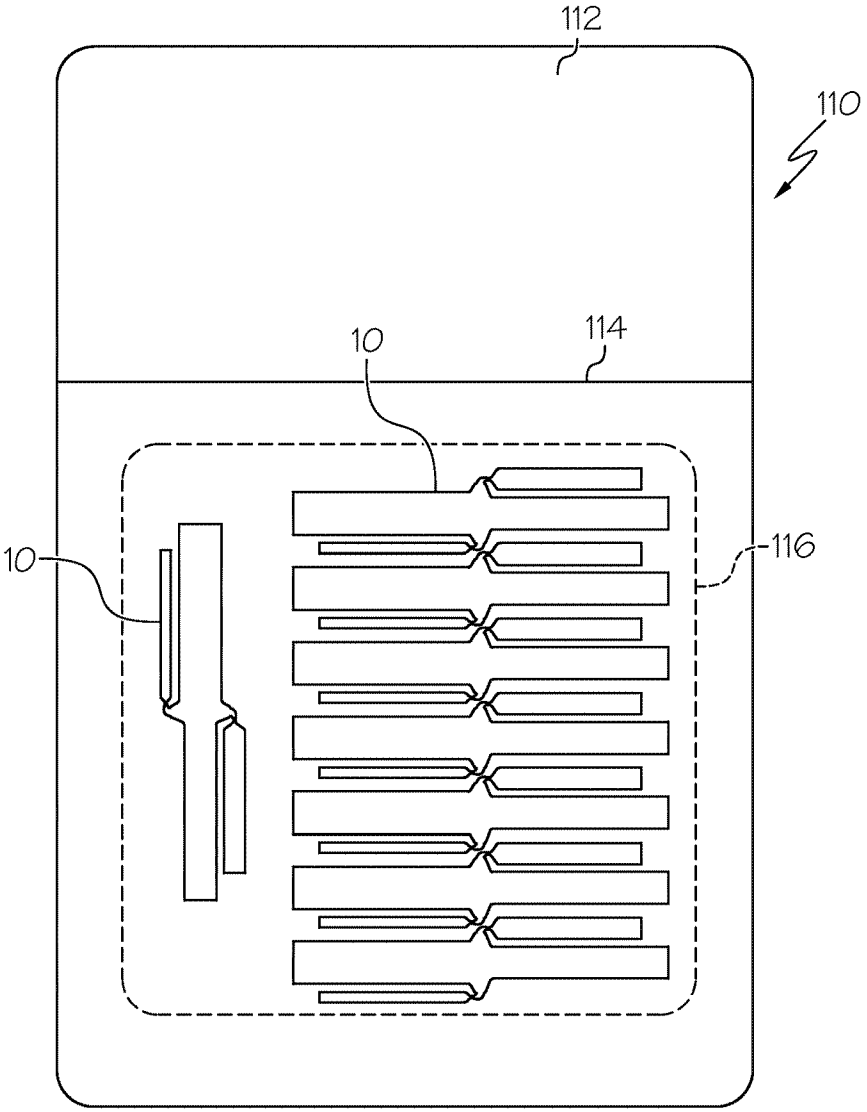
FIG. 14 shows another embodiment of a spacer package assembly.
Figure 13:
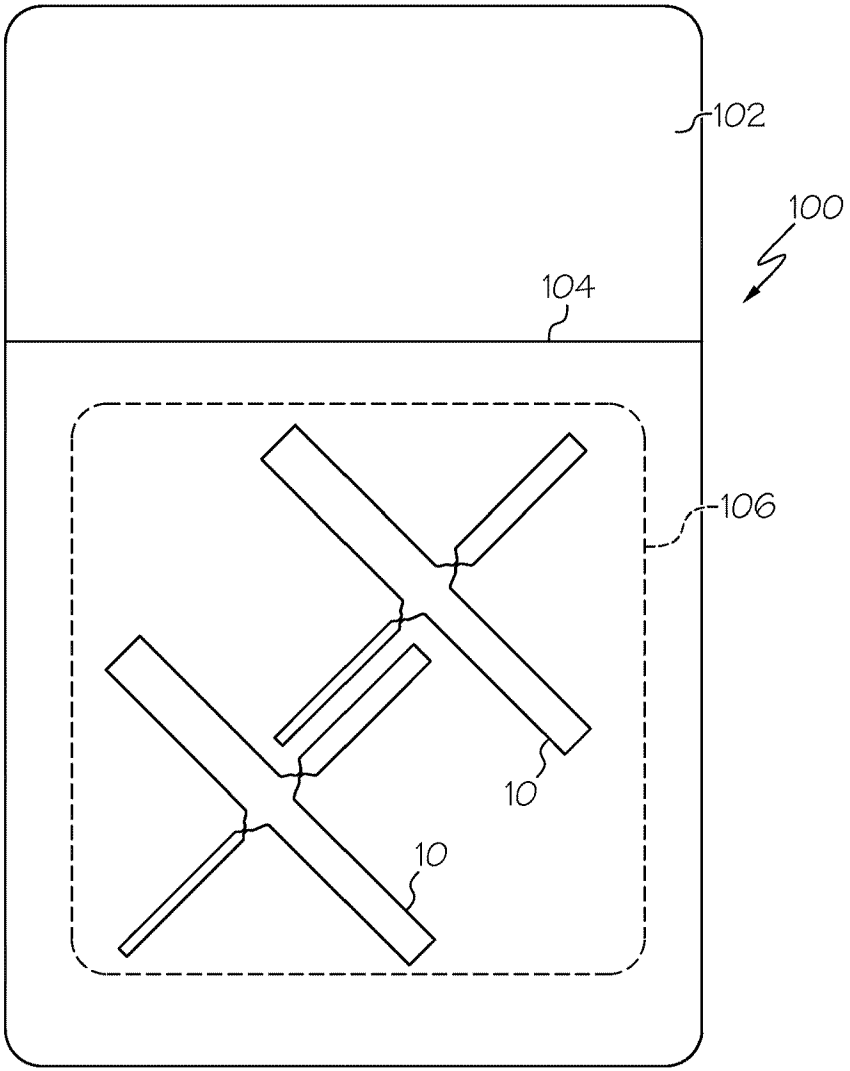
FIG. 13 shows another embodiment of a spacer package assembly.

Although the above packaging examples reflect the spacing member being packaged in a collapsed form, it is also recognized that in some instances the spacing member, or at least one spacing member of multiple spacing members within a package, could be in the un-collapsed, working configuration. For example, the package assembly 100 of FIG. 13, two spacer members 10 are contained between a panel member 102 and a blister member 104, where dashed line 106 represents the raised portion of the blister member. Each of the spacer members is lying on edge, in un-collapsed form within the package. In the package assembly 110 of FIG. 14, eight spacer members 10 are contained between a panel member 112 and a blister member 114, where dashed line 116 represents the raised portion of the blister member. Each of the spacer members is lying on edge, in collapsed form within the package.

Figure 12:
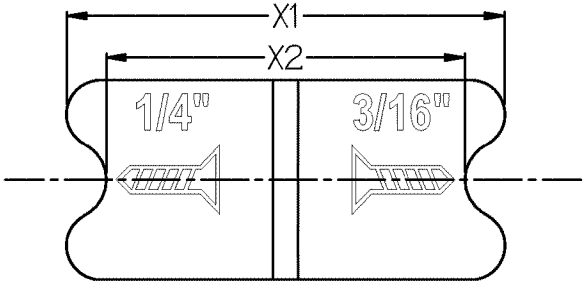
FIG. 12 shows another side view of the spacer member of FIG. 1.

The dimensions of the spacer member 10 can vary widely. However, referring to FIGS. 11 and 12, exemplary suitable dimensions for the spacer member may include Y1 between about 1.5" and 3.0", Y2 between about 1.20" and 3.40", X1 between about 1.5" and 3.0", X2 between about 1.20" and 3.40" and Z between about 0.50" and about 1.50". In this regard, dimension Y1 represents the largest profile dimension from the distal end of spacing wing 14 to the distal end of spacing wing 16, dimension X1 represents the largest profile dimension from the distal end of spacing wing 18 to the distal end of spacing wing 20, dimension Y2 represents the smallest profile dimension from the distal end of spacing wing 14 to the distal end of spacing wing 16, dimension X2 represents the smallest profile dimension from the distal end of spacing wing 18 to the distal end of spacing wing 20 and dimension Z represents the dimension of the hub or core and, in the illustrated embodiment, the spacing wings, in a direction parallel to the axis 14 of the hub/core. With respect to dimensions Y2 and X2, it is noted that the distal end of each spacing wing 14, 16, 18 and 20 includes a recessed region 100, 102, 104 and 106, and the dimensions Y2 and X2 are measured from recess bottom to recess bottom. Generally, it is contemplated that dimensions X1 and Y1 will be substantially the same, and dimensions X2 and Y2 will be substantially the same, but variations are possible.

Figure 11:
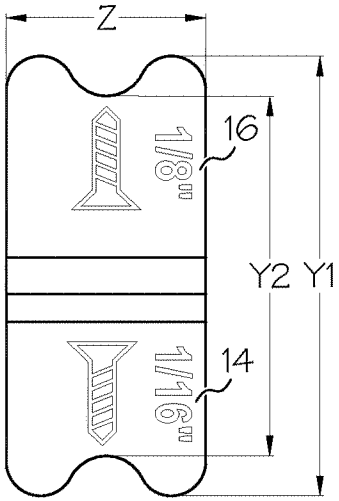
FIG. 11 shows one side view of the spacer member of FIG. 1.

In the illustrated embodiment, as best seen in FIGS. 3 and 11, the recessed regions help identify a suitable location at which a screw-type fastener 200 can be placed for fasting down a deck board 40 into a joist 202. In this regard, it is therefore preferred that the dimensions X2 and Y2 be at least 1.0 inch or more, so as to assure that the screw is not positioned too close to the edge of the board 40. Thus, the spacing member provides a deck board installation methodology that includes (a) positioning a first deck board on a support arrangement (e.g., an underlying joist system), (b) positioning a second deck board on the support arrangement, (c) positioning the spacing member with a first spacing wing extending downward between the first and second deck boards, (d) moving at least one of the boards so that the first spacing wing defines a gap size between the first and second deck boards, (e) placing a first screw into the first deck board to secure the first deck board to the support arrangement, where the first screw is placed at a location defined by a recess at the end of a second spacing wing, and (f) placing a second screw into the second deck board to secure the second deck board to the support arrangement, where the second screw is placed at a location defined by a recess at the end of a third spacing wing. The spacing member can then be slid along the gap between the first and second deck boards to another location where steps (e) and (f) can be repeated.

It is to be clearly understood that the above description is intended by way of illustration and example only, is not intended to be taken by way of limitation, and that other changes and modifications are possible. For example, while the use of living hinges is primarily described to facilitate movement of the spacer member between working and collapsed configurations, other structures could be used (e.g., actual hinges formed by interconnecting components).

What is claimed is:

1. A spacer member for spacing boards or tiles, the spacer comprising:

a hub;

first, second, third and fourth spacing wings extending from the hub, at least the first spacing wing and the second spacing wing are movably connected to the hub such that the spacer member has both a working configuration and a collapsed configuration; wherein:

the first spacing wing and the second spacing wing extend from opposite sides of the hub;

the third spacing wing and the fourth spacing wing extend from opposite sides of the hub; and in the working configuration, the first spacing wing and the second spacing wing extend substantially parallel to each other, the third spacing wing and fourth spacing wing extend substantially parallel to each other in a first plane, and the first spacing wing and the second wing extend substantially parallel to each other in a second plane, and the first plane extends substantially perpendicular to the second plane.

2. The spacer member of claim 1, wherein:

in the collapsed configuration, the third spacing wing and fourth spacing wing extend substantially parallel to each other, the first spacing wing is positioned alongside one of the third spacing wing or the fourth spacing wing, and the second spacing wing is positioned alongside one of the third spacing wing or the fourth spacing wing.

3. The spacer member of claim 1, wherein:

in the working configuration the first spacing wing is spaced apart from both the third spacing wing and the fourth spacing wing, and the second spacing wing is spaced apart from both the third spacing wing and the fourth spacing wing;

in the collapsed configuration, the first spacing wing is positioned alongside one of the third spacing wing or the fourth spacing wing, and the second spacing wing is positioned alongside one of the third spacing wing or the fourth spacing wing.

4. The spacer member of claim 1 wherein the spacer member is formed of a plastic material, a first living hinge connects the first spacing wing to the hub and a second living hinge connects the second spacing wing to the hub.

5. The spacer member of claim 4 wherein the first living hinge acts to bias the first spacing wing into a working position corresponding to the working configuration, and the second living hinge acts to bias the second spacing wing into a working position corresponding to the working configuration.

6. The spacer member of claim 1 wherein the first, second, third and fourth spacing wings each individually define respective spacing widths and collectively define at least three different spacing widths.

7. A package assembly, comprising the spacer member of claim 1, and further comprising:

packaging material defining a carrying space;

the spacer member of claim 1 positioned within the carrying space and held in the collapsed configuration by the packaging material.

8. The package assembly of claim 7 wherein the packaging material comprises a blister card package, a clam shell package or a bag.

9. The package assembly of claim 7 wherein, upon removal of the spacer member from the packaging material, the first and second spacing wings tend to move toward respective positions that correspond to the working configuration.

10. A kit including the package assembly of claim 7, comprising:

a container having a closure, the container holding (i) a plurality of threaded fasteners and (ii) the package assembly of claim 7.

11. The kit of claim 10 wherein the container is a box member and the closure is a lid on the box member.

12. A spacer member for spacing boards or tiles, the spacer comprising:

a hub;

first, second, third and fourth spacing wings extending from the hub, at least the first spacing wing and the second spacing wing are movably connected to the hub such that the spacer member has both a working configuration and a collapsed configuration; wherein:

the third spacing wing and the fourth spacing wing extend from substantially opposite sides of the hub and generally parallel to each other;

a thickness of the spacer member runs substantially perpendicular to the third and fourth spacing wings;

the thickness of the spacer member when in the collapsed configuration is no more than thirty percent of the thickness of the spacer member when in the working configuration.

13. A spacer member for spacing boards or tiles, the spacer comprising:

a hub;

first, second, third and fourth spacing wings extending from the hub, at least the first spacing wing and the second spacing wing are movably connected to the hub such that the spacer member has both a working configuration and a collapsed configuration; wherein, in the absence of any external force holding the spacer member in the collapsed configuration, the first and second spacing wings tend to move toward respective positions that correspond to the working configuration.

14. A spacer member for spacing boards or tiles, the spacer comprising:

a plurality of spacing wings extending from a core, at least two of the spacing wings are movably connected to the core such that the spacer member has both a working configuration and a collapsed configuration; wherein:

in the working configuration, each one of the plurality of the spacing wings extends outwardly from the core such that the spacer member has a substantially cross-shaped profile when viewed along an axis of the core, in the collapsed configuration a first pair of the spacing wings lie alongside each other and a second pair of the spacing wings lie alongside each other;

in the absence of any external force holding the spacer member in the collapsed configuration, the spacing wings tend to move toward respective positions that correspond to the working configuration.

15. A kit including the spacer member of claim 14, comprising:

a container having a closure, the container holding (i) a plurality of threaded fasteners and (ii) the spacer member of claim 14.

16. A spacer member for spacing boards or tiles, the spacer comprising:

first, second, third and fourth spacing wings extending from a core, wherein the first, second, third and fourth spacing wings each individually define respective spacing widths and collectively define at least three different spacing widths;

wherein at least the first spacing wing and the second spacing wing are movably connected to the core such that the spacer member has both a working configuration that is cross-shaped, and a collapsed configuration; and wherein, in the absence of any external force holding the spacer member in the collapsed configuration, the first and second spacing wings tend to move toward respective positions that correspond to the working configuration.

* * * * *